US009922781B2

(12) United States Patent
Zhou

(10) Patent No.: US 9,922,781 B2
(45) Date of Patent: Mar. 20, 2018

(54) HYBRID MCCB EMPLOYING ELECTROMECHANICAL CONTACTS AND POWER ELECTRONIC DEVICES

(71) Applicant: Eaton Corporation, Cleveland, OH (US)

(72) Inventor: Xin Zhou, Wexford, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 15/409,963

(22) Filed: Jan. 19, 2017

(65) Prior Publication Data

US 2017/0358403 A1 Dec. 14, 2017

Related U.S. Application Data

(60) Provisional application No. 62/347,211, filed on Jun. 8, 2016.

(51) Int. Cl.
*H01H 9/54* (2006.01)

(52) U.S. Cl.
CPC ..... *H01H 9/542* (2013.01); *H01H 2009/544* (2013.01); *H01H 2009/546* (2013.01)

(58) Field of Classification Search
CPC .... H01H 1/0036; H01H 1/62; H01H 59/0009; H01H 36/00; H01H 83/04; H01H 1/08;
(Continued)

(56) References Cited

U.S. PATENT DOCUMENTS 3,997,749 A 12/1976 Hanagan
4,858,056 A * 8/1989 Russell ..... H01H 83/20 361/42

(Continued)

FOREIGN PATENT DOCUMENTS

EP 2 465 129 A1 6/2012
EP 2801994 A1 12/2014
WO 2011/034140 A1 2/2013

OTHER PUBLICATIONS

Theisen, P.J. et al., "270-V DC Hybrid Switch," IEEE Transactions on Components, Hybrids, and Manufacturing Technology, vol. CHMT-9, No. 1, Mar. 1986, 4 pages.

(Continued)

*Primary Examiner* — Truc Nguyen

(74) *Attorney, Agent, or Firm* — Eckert Seamans; David Jenkins; Grant Coffield

(57) ABSTRACT

A hybrid switch assembly for a circuit breaker assembly is provided. The circuit breaker assembly includes a housing assembly and an operating mechanism. The housing assembly defines a power electronic switch assembly cavity. A hybrid switch assembly includes a number of conductor assemblies, each conductor assembly including a movable conductor, and a stationary conductor. Further, each movable conductor is structured to move between an open, first position, wherein each movable conductor is spaced from and not in electrical communication with an associated stationary conductor, and a closed, second position, wherein each movable conductor is coupled to and in electrical communication with an associated stationary conductor. A number of the conductor assemblies further include a power electronic switch assembly. Each power electronic switch assembly includes an isolation contact assembly. Each isolation contact assembly is selectively coupled to, and in electronic communication with, the stationary conductor and the movable conductor.

18 Claims, 19 Drawing Sheets

(58) Field of Classification Search
CPC ..... H01H 2029/008; H01H 2071/044; H01H 50/005; H01H 51/065; H01H 71/04; H01H 47/08; H01H 73/045; H01H 1/66
See application file for complete search history.

(56) References Cited

U.S. PATENT DOCUMENTS 5,295,037 A * 3/1994 Dougherty ..... H01H 71/123 361/93.2
7,742,264 B2 * 6/2010 Hyun ..... H02H 7/001 335/216
8,416,541 B1 4/2013 White
8,817,443 B2 * 8/2014 Gao ..... H01H 9/302 361/115
2013/0154774 A1 * 6/2013 Bhavaraju ..... H01H 47/18 335/127
2013/0180838 A1 * 7/2013 Ahlert ..... H01H 21/22 200/400
2013/0199912 A1 8/2013 Azzola et al.
2015/0014277 A1 1/2015 Theisen et al.

OTHER PUBLICATIONS

Meckler, P. et al., "Hybrid switches in protective devices for low-voltage DC grids at commercial used buildings," 27th International Conference on Electrical Contacts, Jun. 22-26, 2014, Dresden, Germany, 6 pages.
Callavik, M., et al., "The Hybrid HVDC Breaker," ABB Grid Systems, Technical Paper, Nov. 2012, 10 pages.
European Patent Office, "International Search Report and Written Opinion", PCT/US2017/031228, dated Jul. 14, 2017, 17 pp.

* cited by examiner

HYBRID MCCB EMPLOYING ELECTROMECHANICAL CONTACTS AND POWER ELECTRONIC DEVICES

CROSS REFERENCE TO RELATED APPLICATION

This application claims the benefit of U.S. Provisional Patent Application Ser. No. 62/347,211, filed Jun. 8, 2016, which is incorporated by reference herein.

BACKGROUND OF THE INVENTION

Field of the Invention

The disclosed and claimed concept relates to a hybrid switch assembly and, more particularly, to a hybrid switch assembly including a power electronic switch assembly with an isolation contact assembly that is selectively coupled to, and in electronic communication with, a movable conductor.

Background Information

Hybrid switching technology has its uniqueness and advantages in switching and interruption for applications such as PV, Data Center, Energy Storage, ICT. Due to the increasingly higher DC system voltages, the challenges to interrupt these DC circuits get higher using electromechanical breakers from the size and cost point of view. Hybrid switching technology combining electromechanical contacts and power electronics such as IGBT, SCR, et al. to achieve successful interruption, current carrying with low Joule heating and galvanic isolation; however, this means a second set of contacts needs to be added in series with main switching contacts for isolation. For example, the switching mechanism of the isolation contacts needs to be sized properly to keep the withstand rating of the device; this increases the cost and size of the breaker. The power electronic circuit also needs external power for its operation. Current hybrid switching technology requires additional voltage and current sensors to provide trigger information for power electronic switches. All these add complexity, size and cost to the device, and this complexity makes hybrid breakers more prone to malfunction. These are stated problems.

SUMMARY OF THE INVENTION

These needs, and others, are met by at least one embodiment of this invention which provides a hybrid switch assembly for a circuit breaker assembly. The circuit breaker assembly includes a housing assembly and an operating mechanism. The housing assembly defines a power electronic switch assembly cavity. The operating mechanism is structured to move a number of movable conductors between an open, first position, wherein each movable conductor is spaced from and not in electrical communication with a stationary conductor, and a closed, second position, wherein each movable conductor is coupled to and in electrical communication with a stationary conductor. The hybrid switch assembly includes a number of conductor assemblies, each conductor assembly including a movable conductor, and a stationary conductor. Further, each movable conductor is movably coupled to the housing assembly and structured to move between an open, first position, wherein each movable conductor is spaced from and not in electrical communication with an associated stationary conductor, and a closed, second position, wherein each movable conductor is coupled to and in electrical communication with an associated stationary conductor. A number of the conductor assemblies further include a power electronic switch assembly. In an exemplary embodiment, each power electronic switch assembly includes an isolation contact assembly. Each isolation contact assembly is selectively coupled to, and in electrical communication with, the stationary conductor and said movable conductor.

The hybrid switch assembly described below solves the problems stated above.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
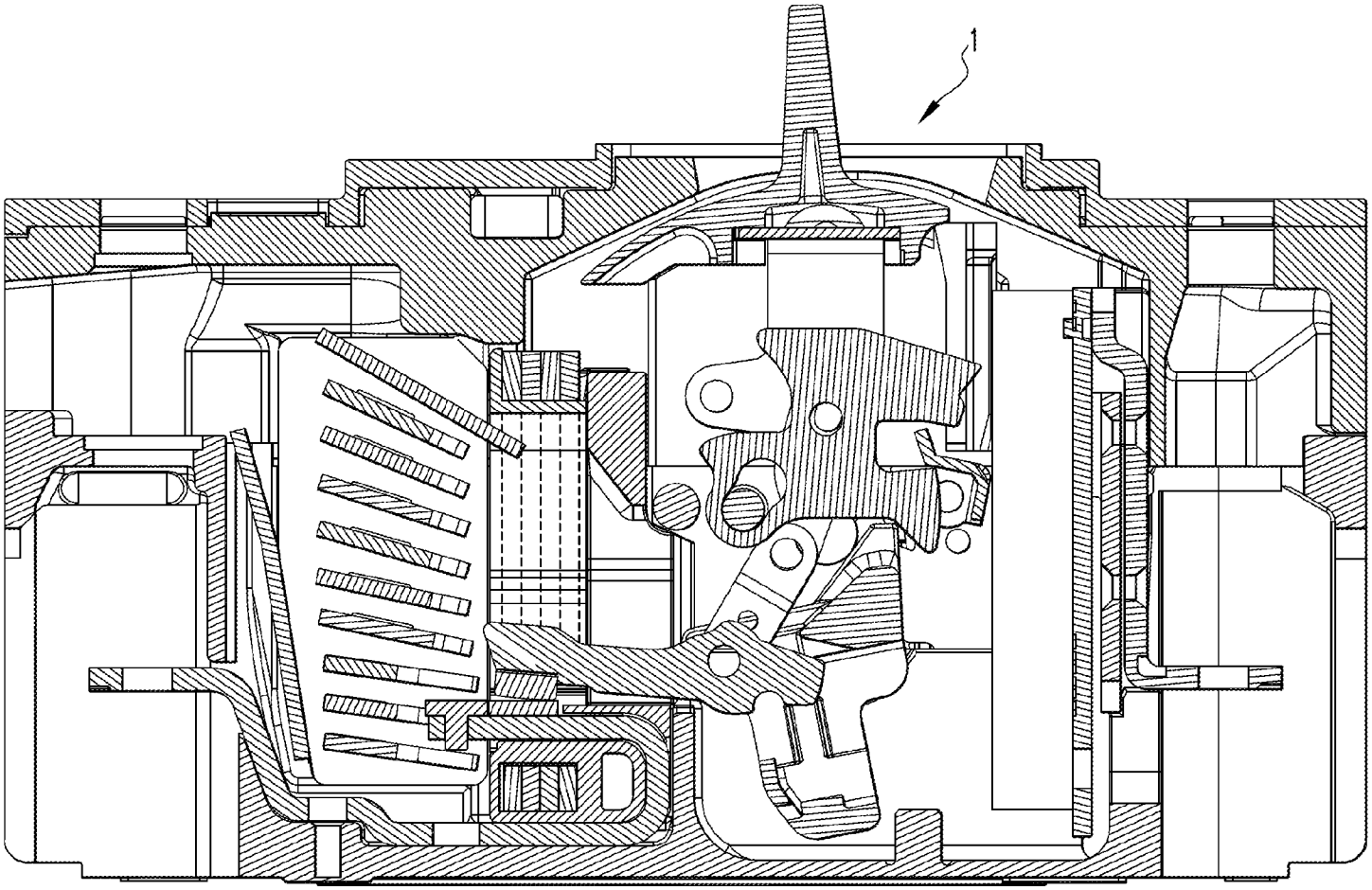
FIG. 1 PRIOR ART
FIG. 1 is a cross-sectional side view of a prior art circuit breaker assembly.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, the phrase "removably coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, a "path of travel" or "path," when used in association with an element that moves, includes the space an element moves through when in motion. As such, any element that moves inherently has a "path of travel" or "path." When used in association with an electrical current, a "path" includes the elements through which the current travels.

As used herein, the statement that two or more parts or components "engage" one another shall mean that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with electronic components, "operatively engage" means that one component controls another component by a control signal or current.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality).

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, when elements are in "electrical communication" a current may flow between the elements. That is, when a current is present and elements are in "electrical communication," then the current flows between the elements. It is understood that elements that are in "electrical communication" have a number of conductive elements, or other constructs, disposed therebetween creating the path for the current.

As used herein, a "clinch joint" is a coupling wherein two conductive elements engage each other so that electromagnetic forces generated at the interface of the conductive members cannot separate the conductive elements. In an exemplary embodiment, a clinch joint includes a clevis and a generally planar lug wherein the clevis is a yoke that has tines disposed on either side of the lug.

Figure 2:
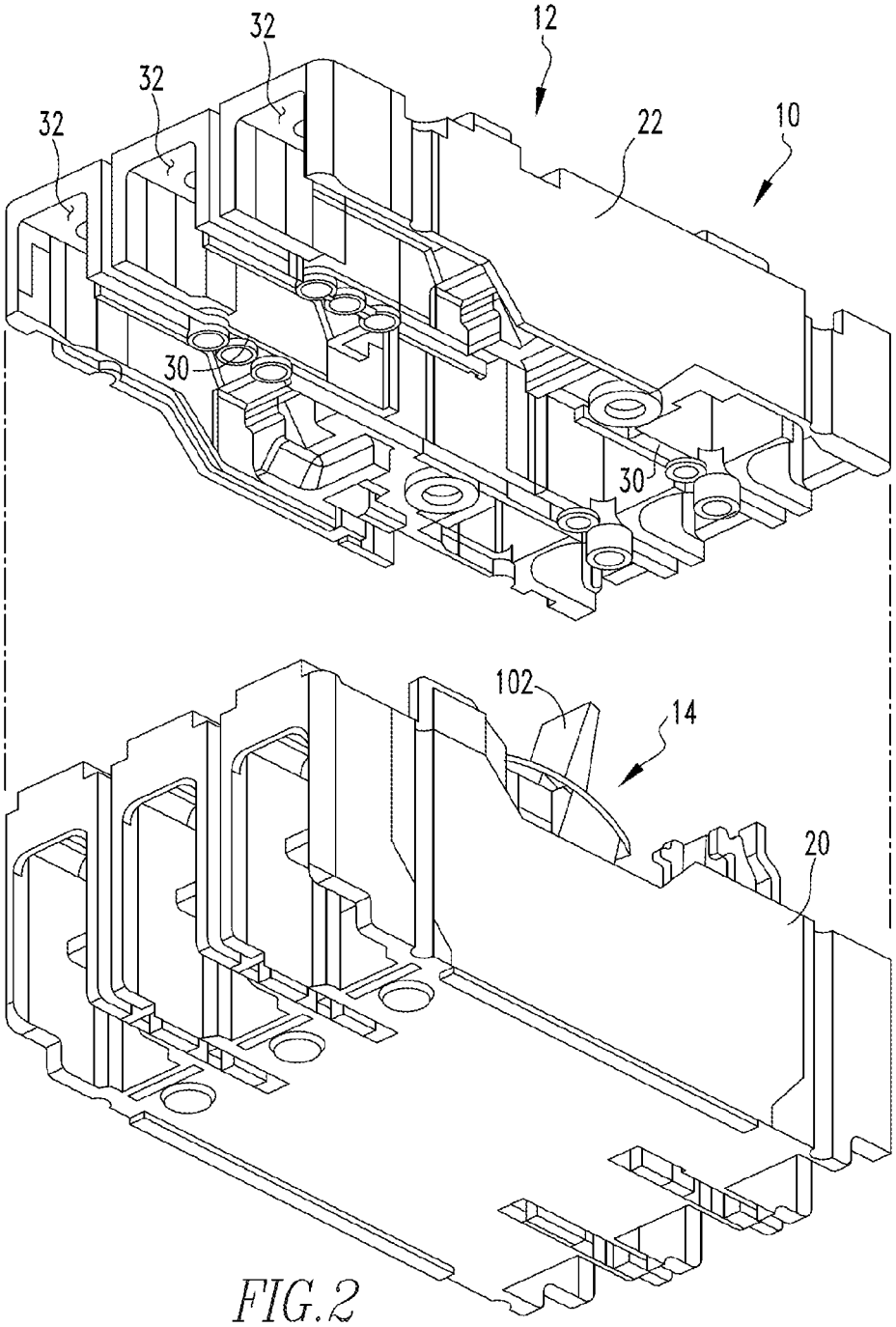
FIG. 2 is an isometric view of a circuit breaker assembly.
Figure 3:
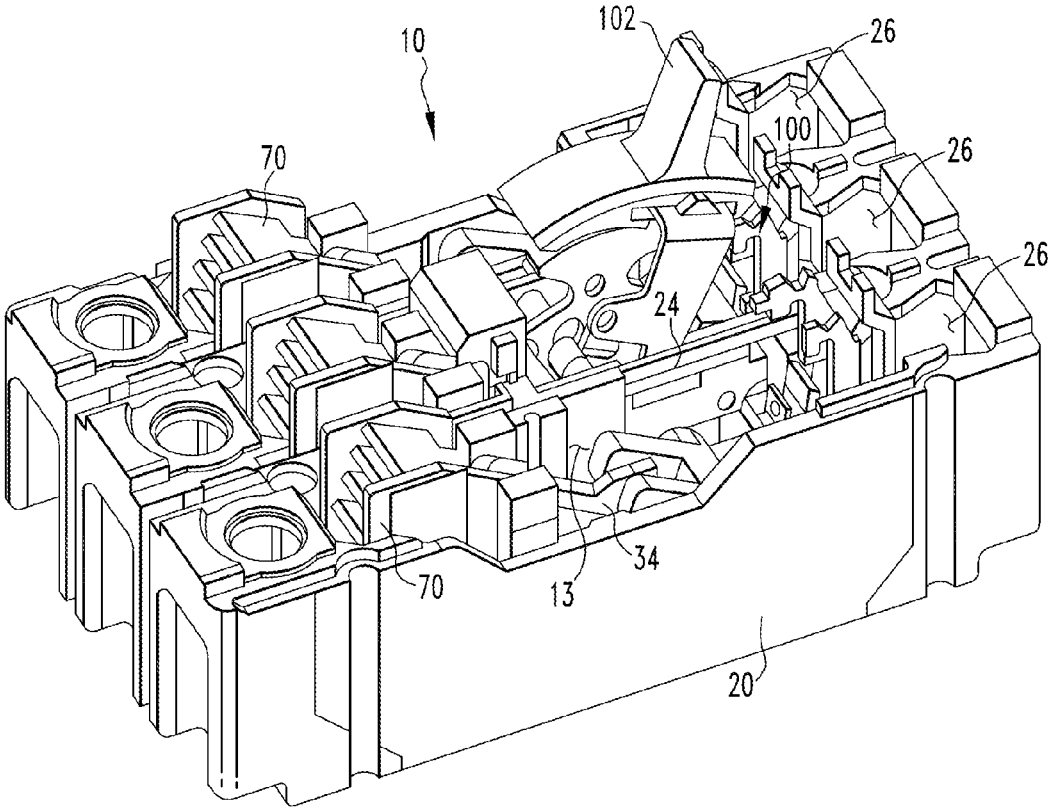
FIG. 3 is another isometric view of a circuit breaker assembly.
Figure 4:
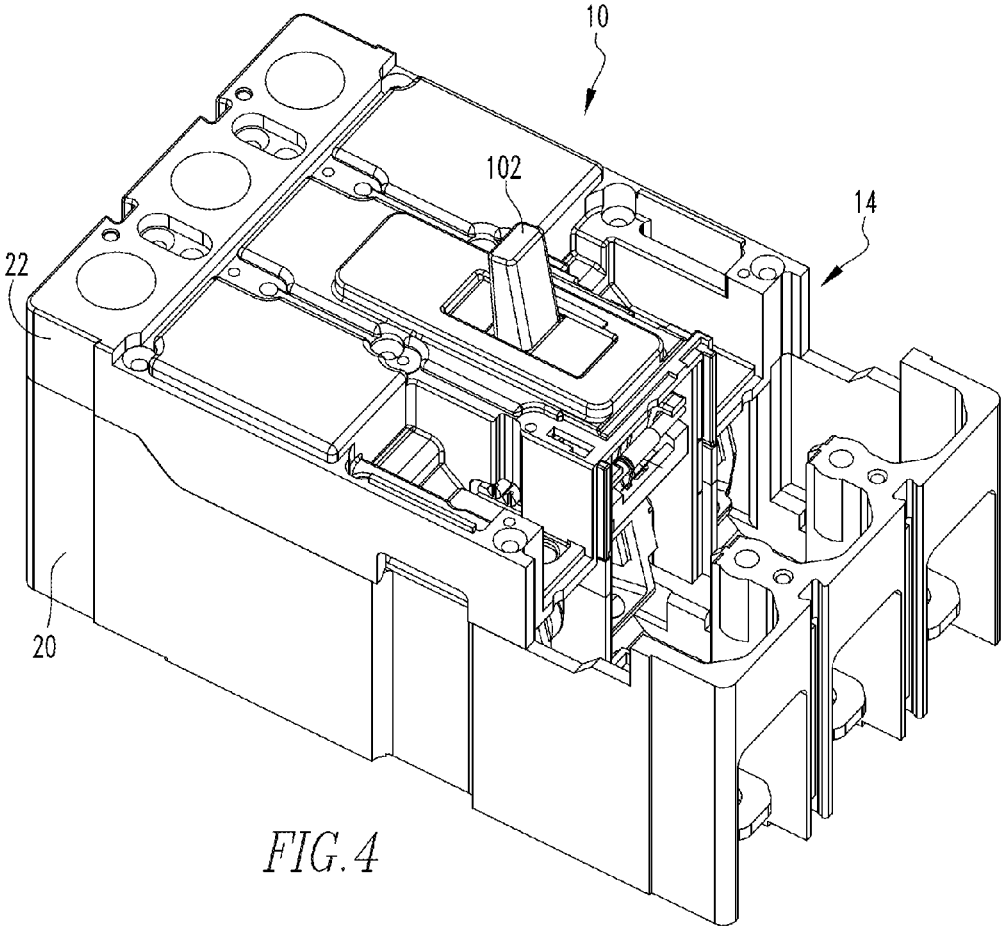
FIG. 4 is another isometric view of a circuit breaker assembly.
Figure 5:
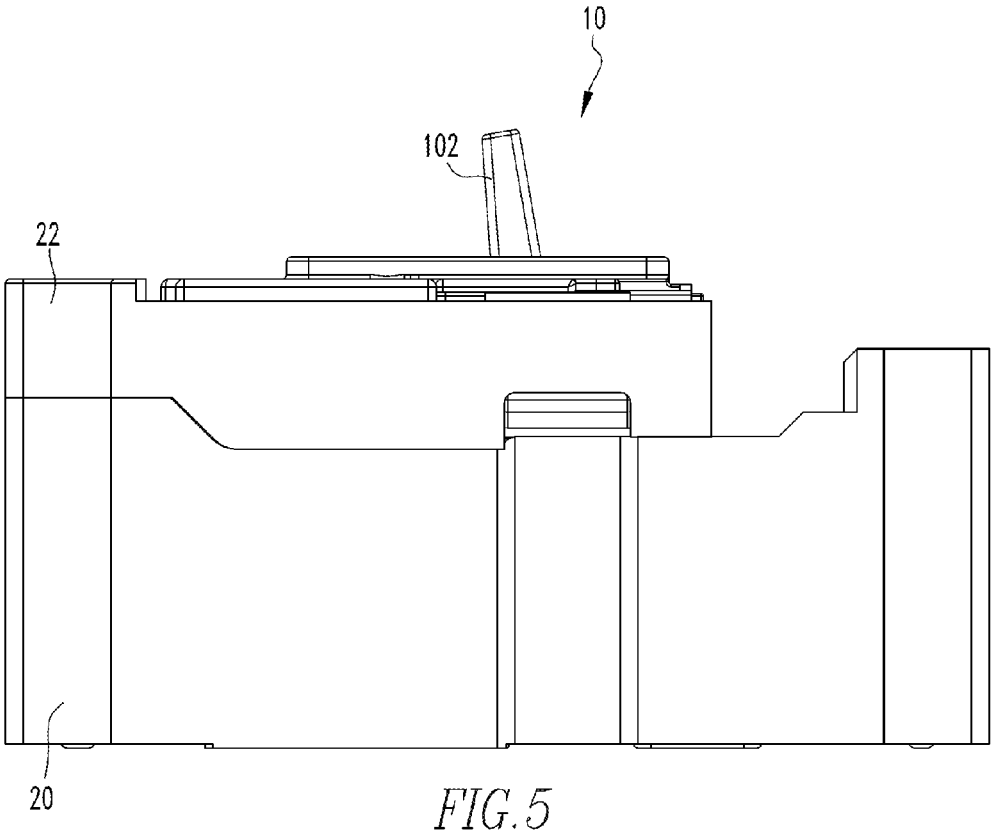
FIG. 5 is a side view of a circuit breaker assembly.
Figure 6:
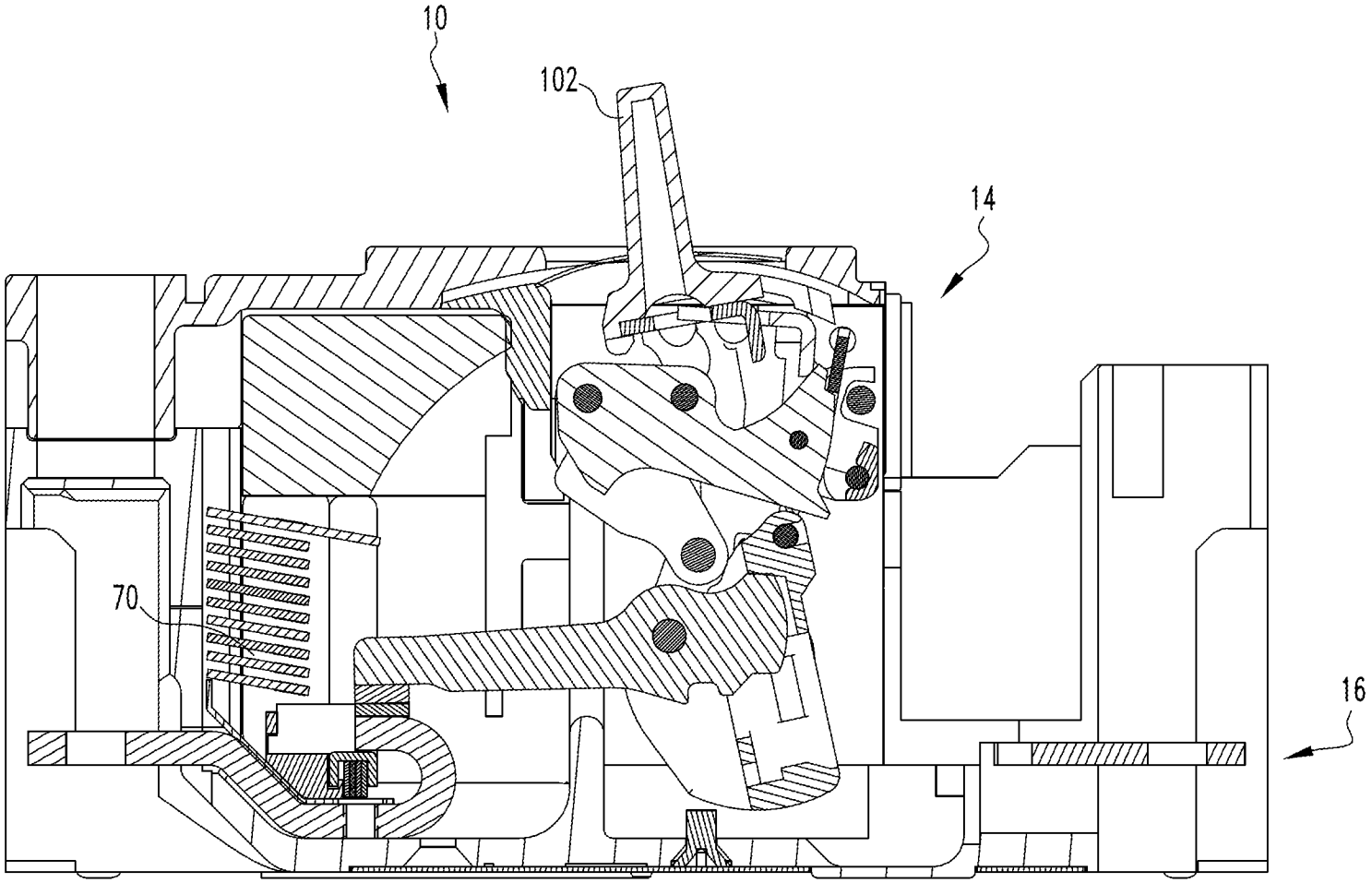
FIG. 6 is a cross-sectional side view of a circuit breaker assembly.
Figure 7:
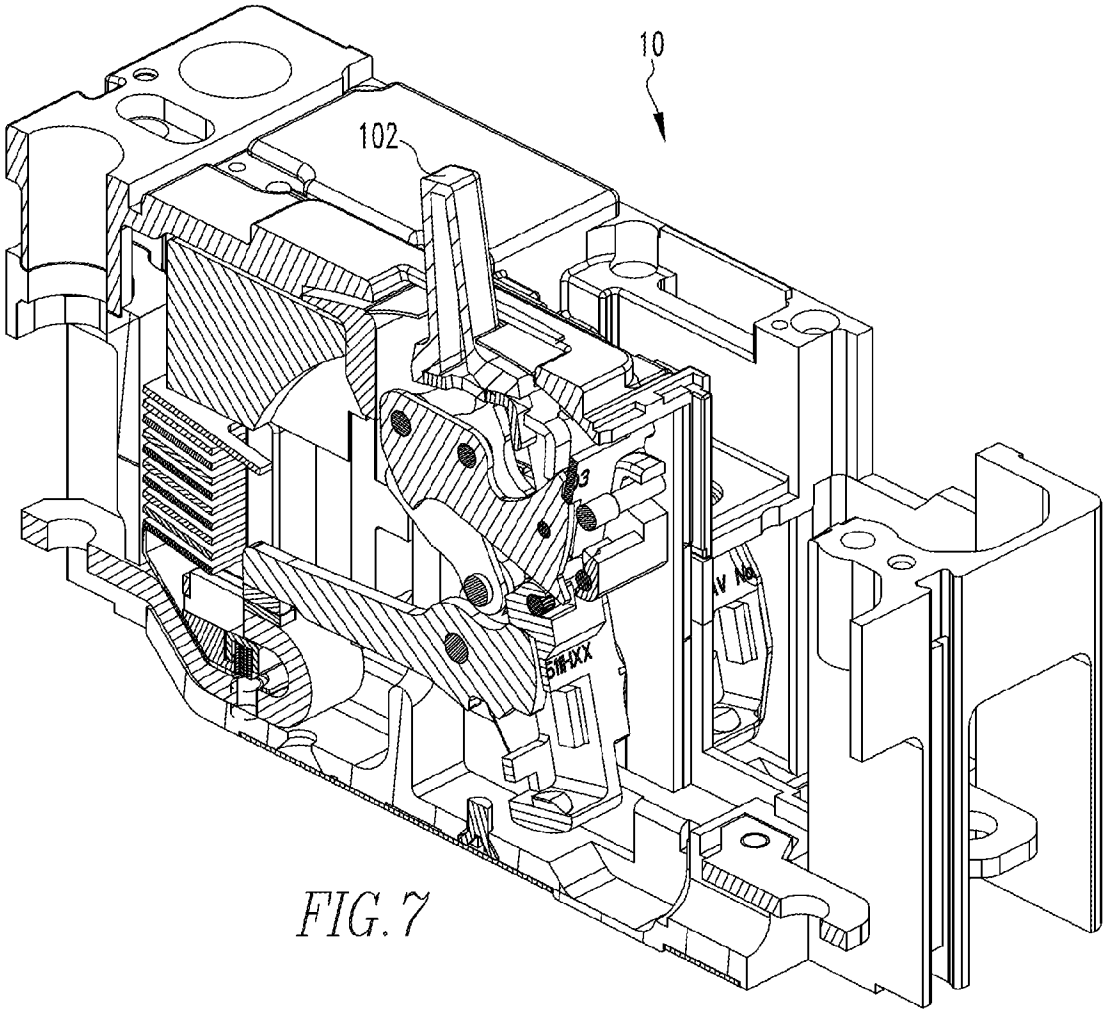
FIG. 7 is a cross-sectional isometric view of a circuit breaker assembly.
Figure 8:
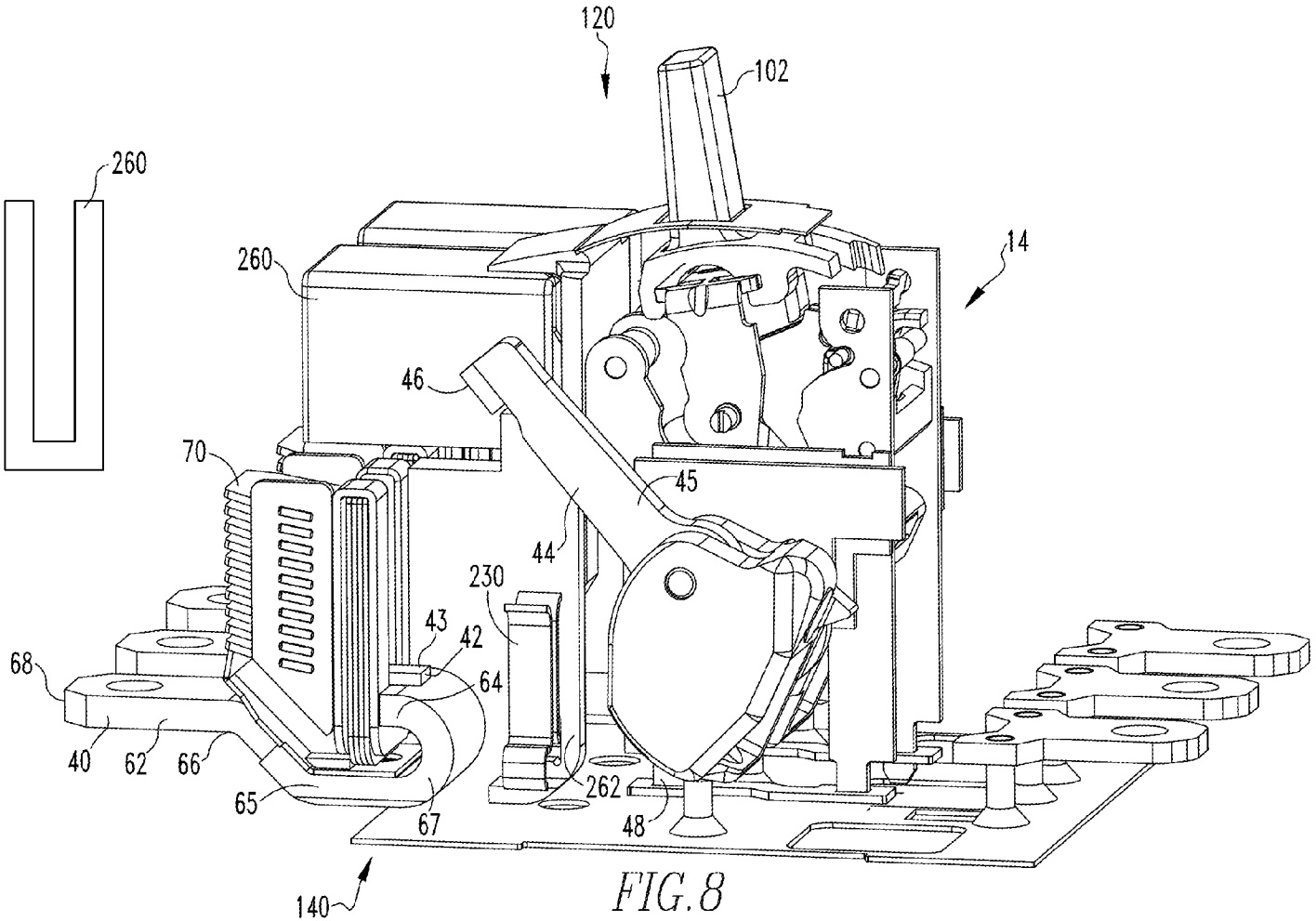
FIG. 8 is a partial isometric view of a hybrid circuit breaker assembly.
Figure 9:
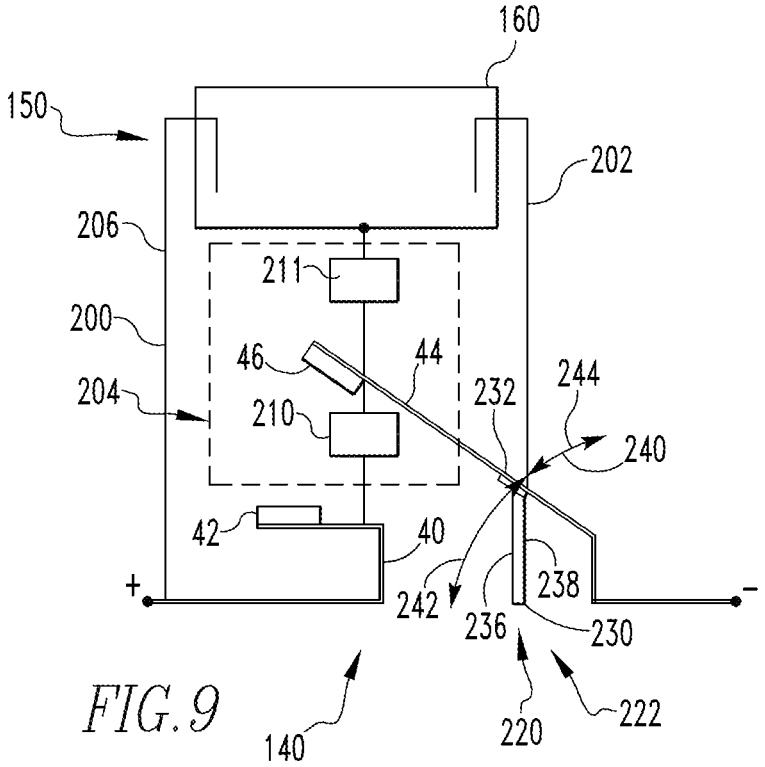
FIG. 9 is a schematic view of a hybrid switch assembly.
Figure 10:
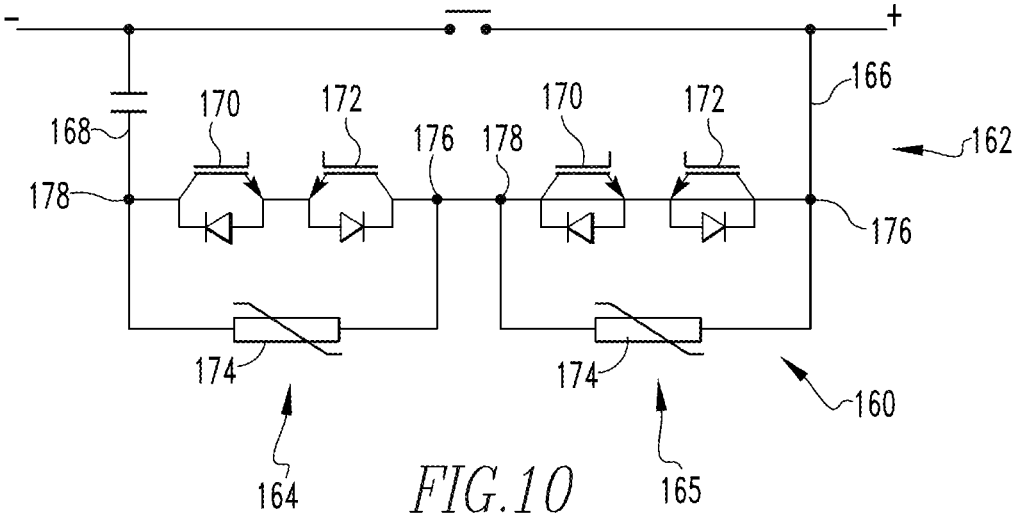
FIG. 10 is a schematic view of a power electronic circuit assembly.
Figure 11A:
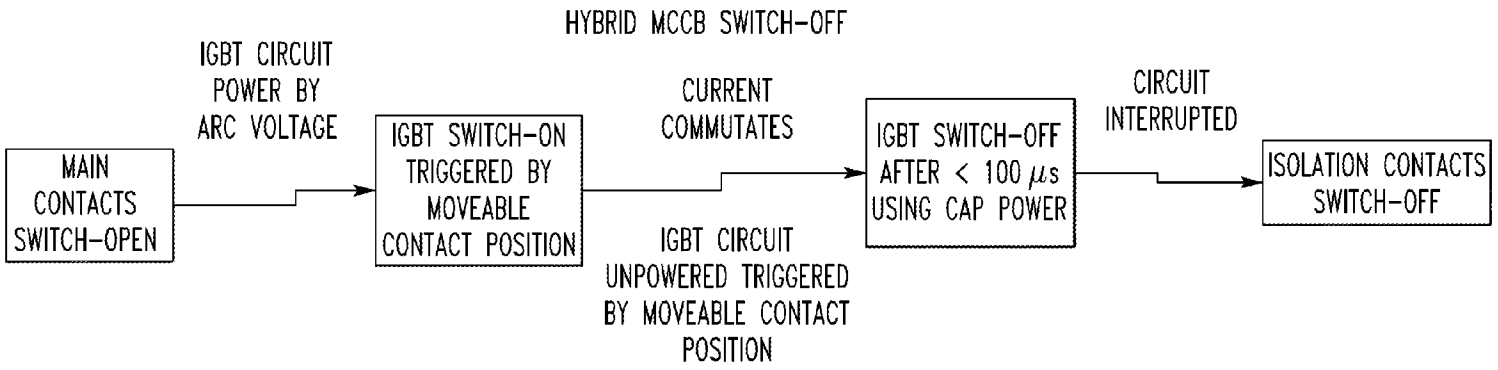
FIGS. 11A and 11B are flow charts showing the state of the hybrid circuit breaker during an opening and closing process.
Figure 11B:
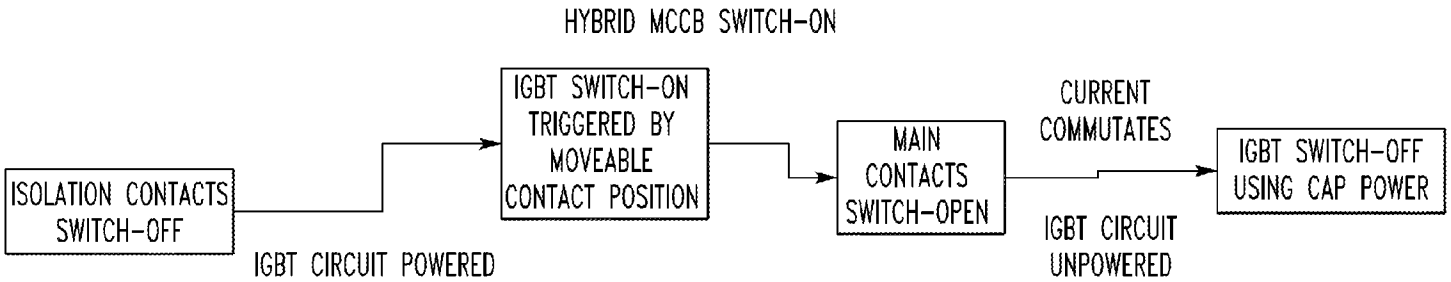
Figure 12:
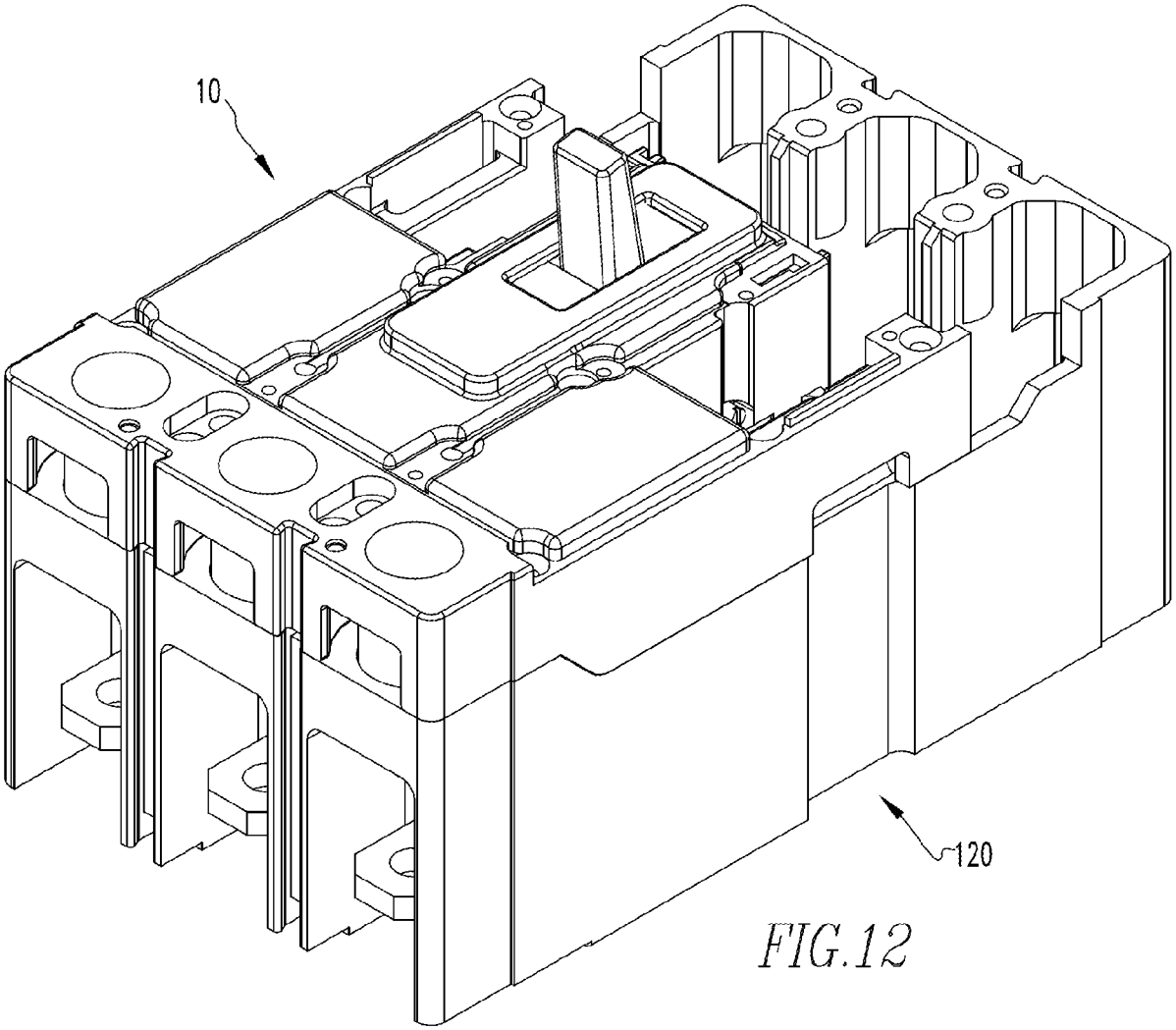
FIG. 12 is another isometric view of a hybrid circuit breaker assembly.
Figure 13:
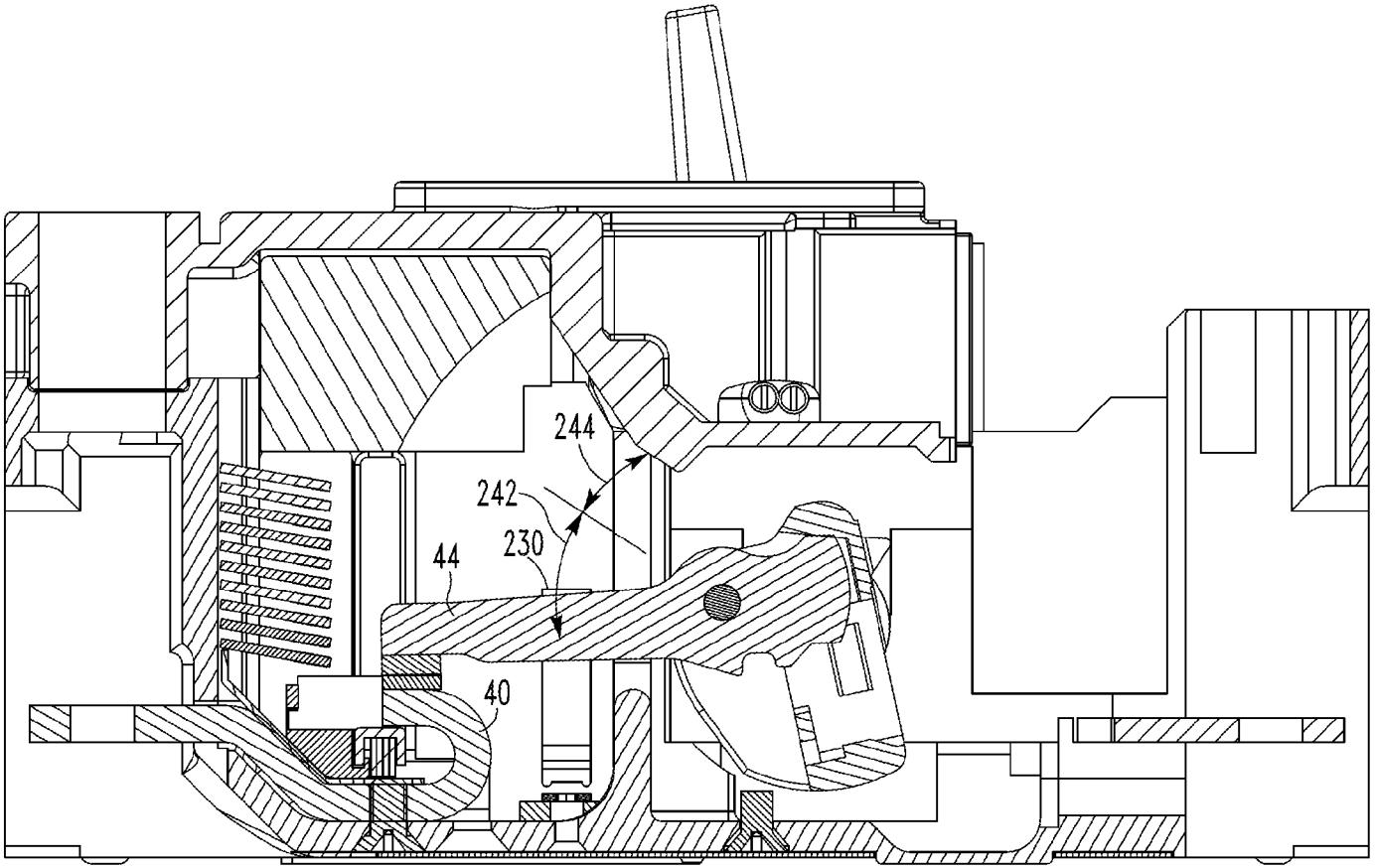
FIG. 13 is another cross-sectional side view of a hybrid circuit breaker assembly.
Figure 14:
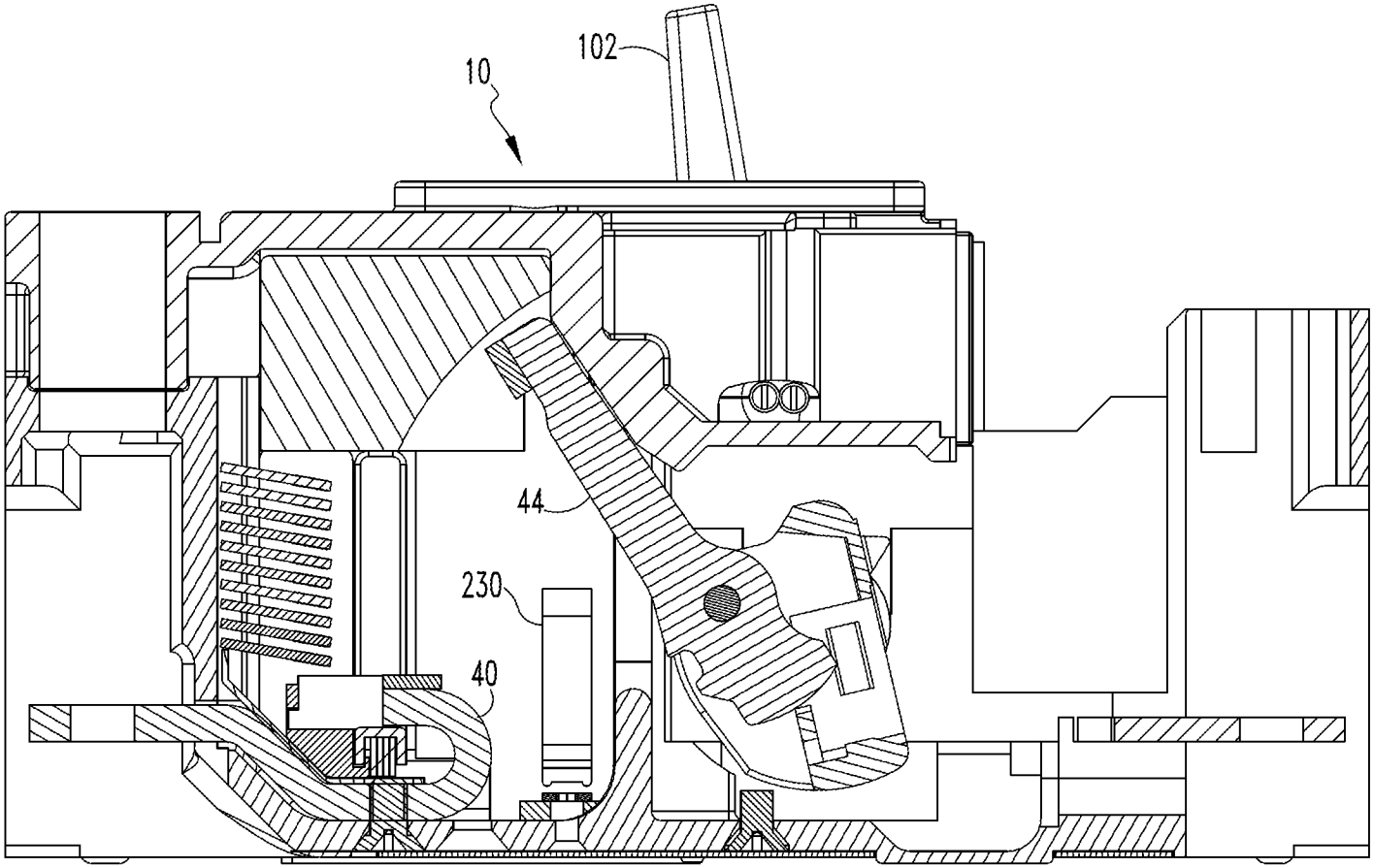
FIG. 14 is another cross-sectional side view of a hybrid circuit breaker assembly.
Figure 15:
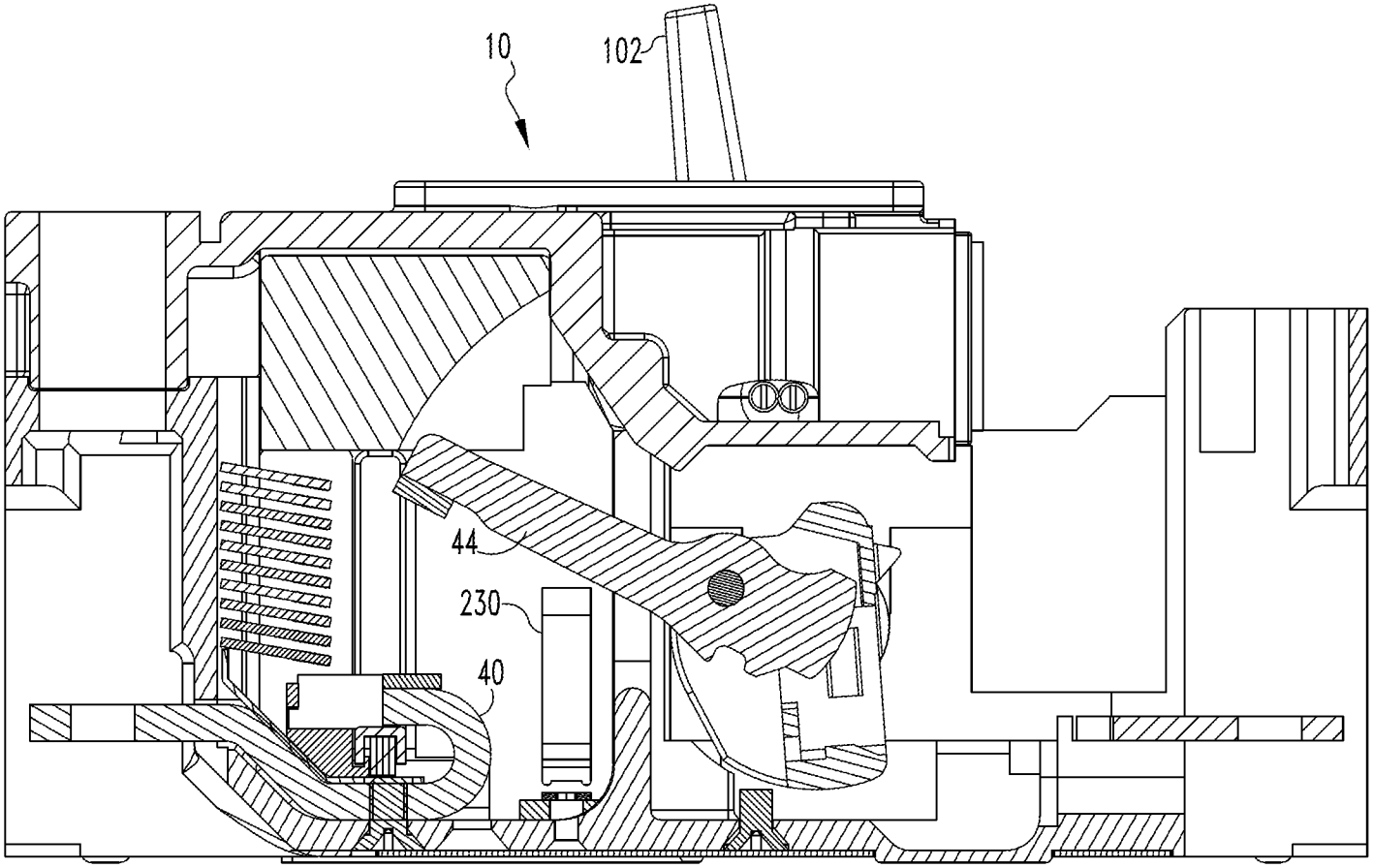
FIG. 15 is another cross-sectional side view of a hybrid circuit breaker assembly.
Figure 16:
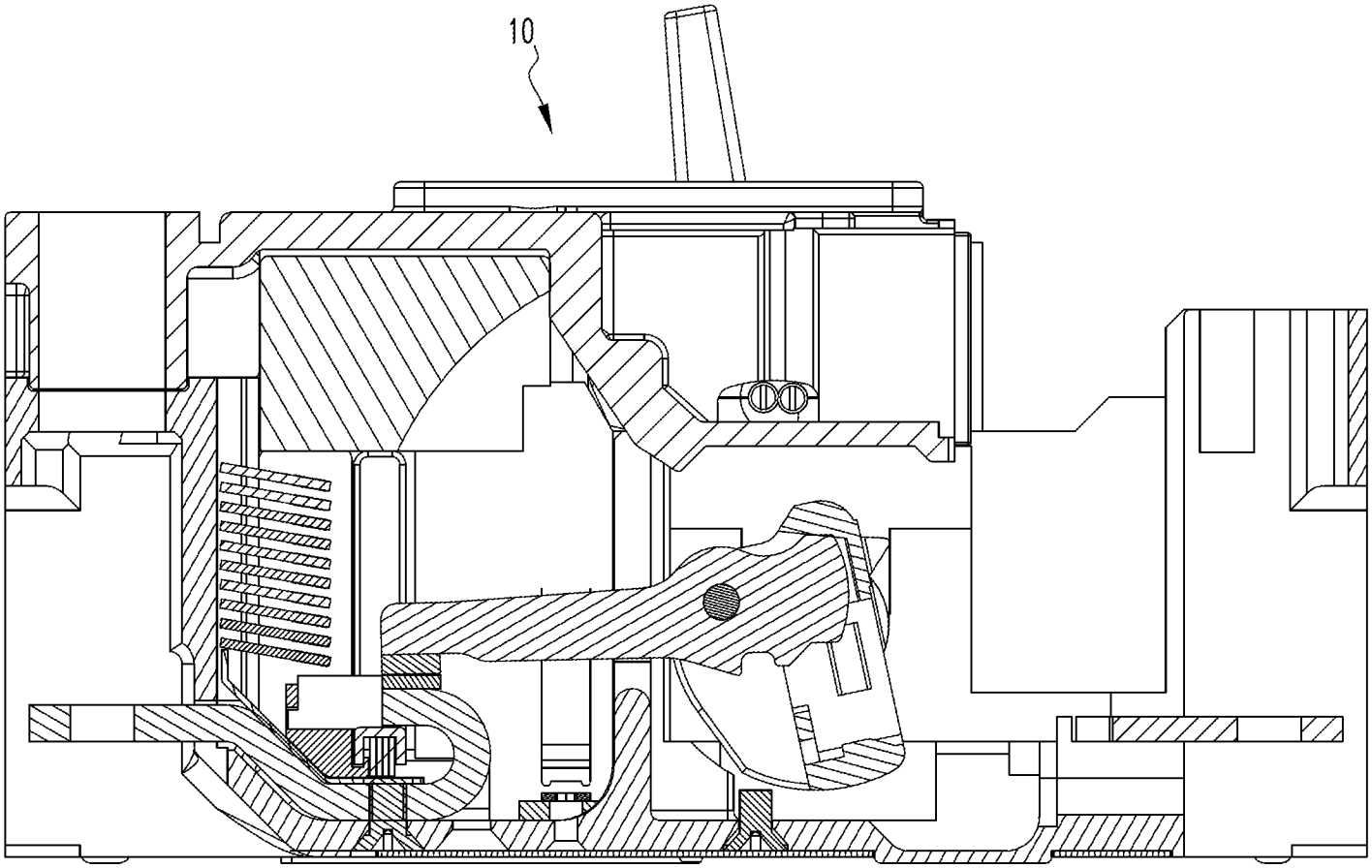
FIG. 16 is another cross-sectional side view of a hybrid circuit breaker assembly.
Figure 17:
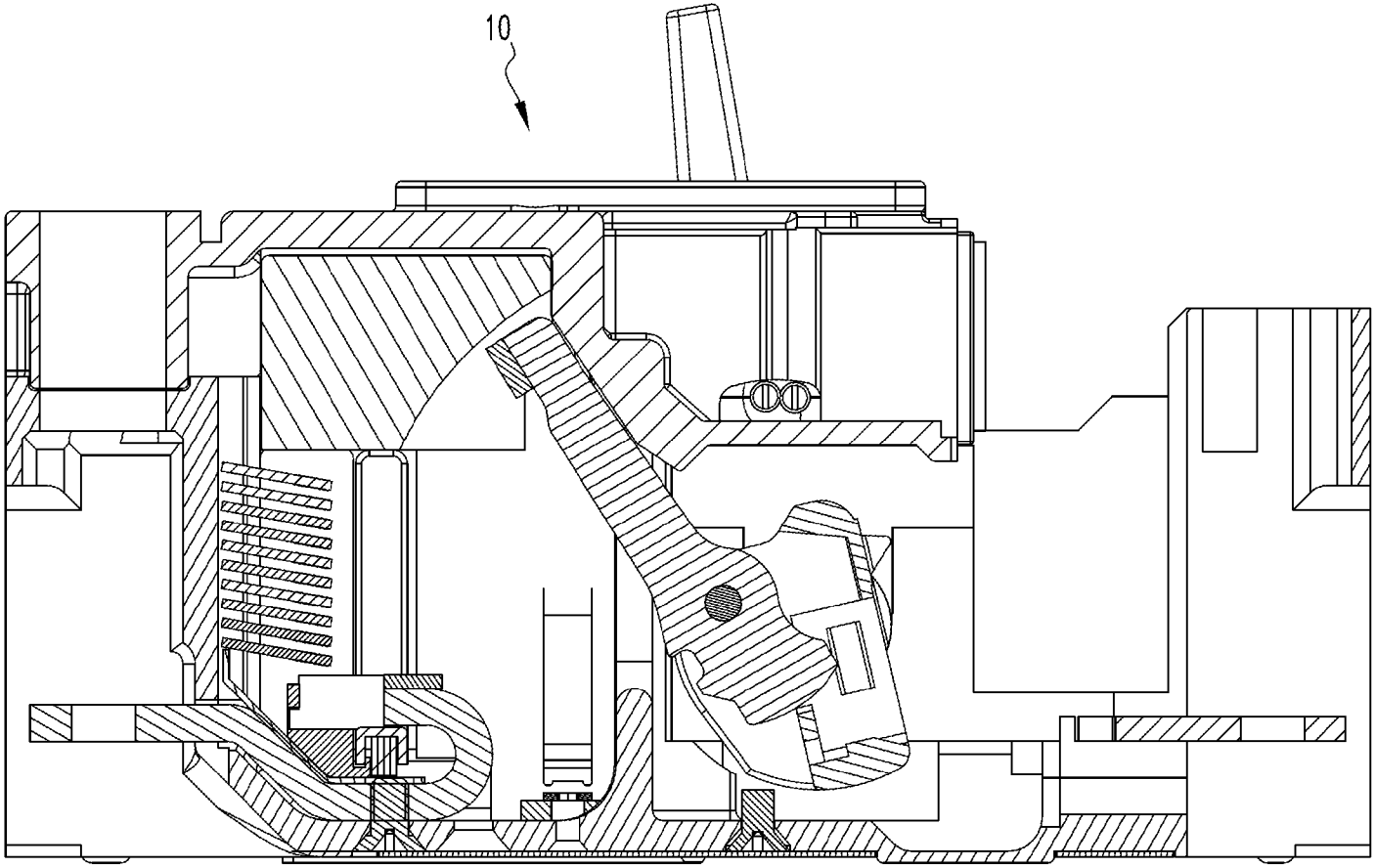
FIG. 17 is another cross-sectional side view of a hybrid circuit breaker assembly.
Figure 18:
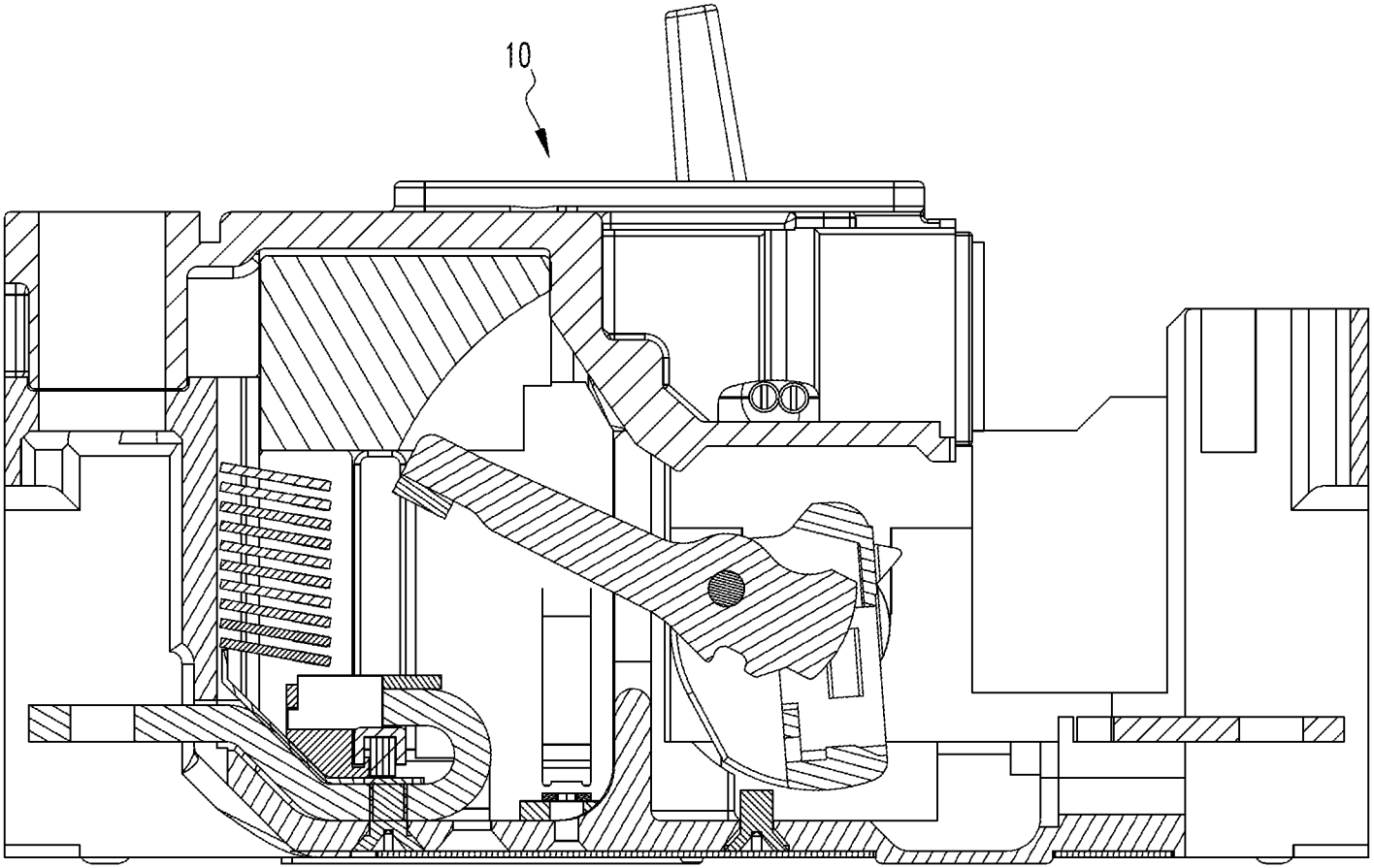
FIG. 18 is another cross-sectional side view of a hybrid circuit breaker assembly.
Figure 19:
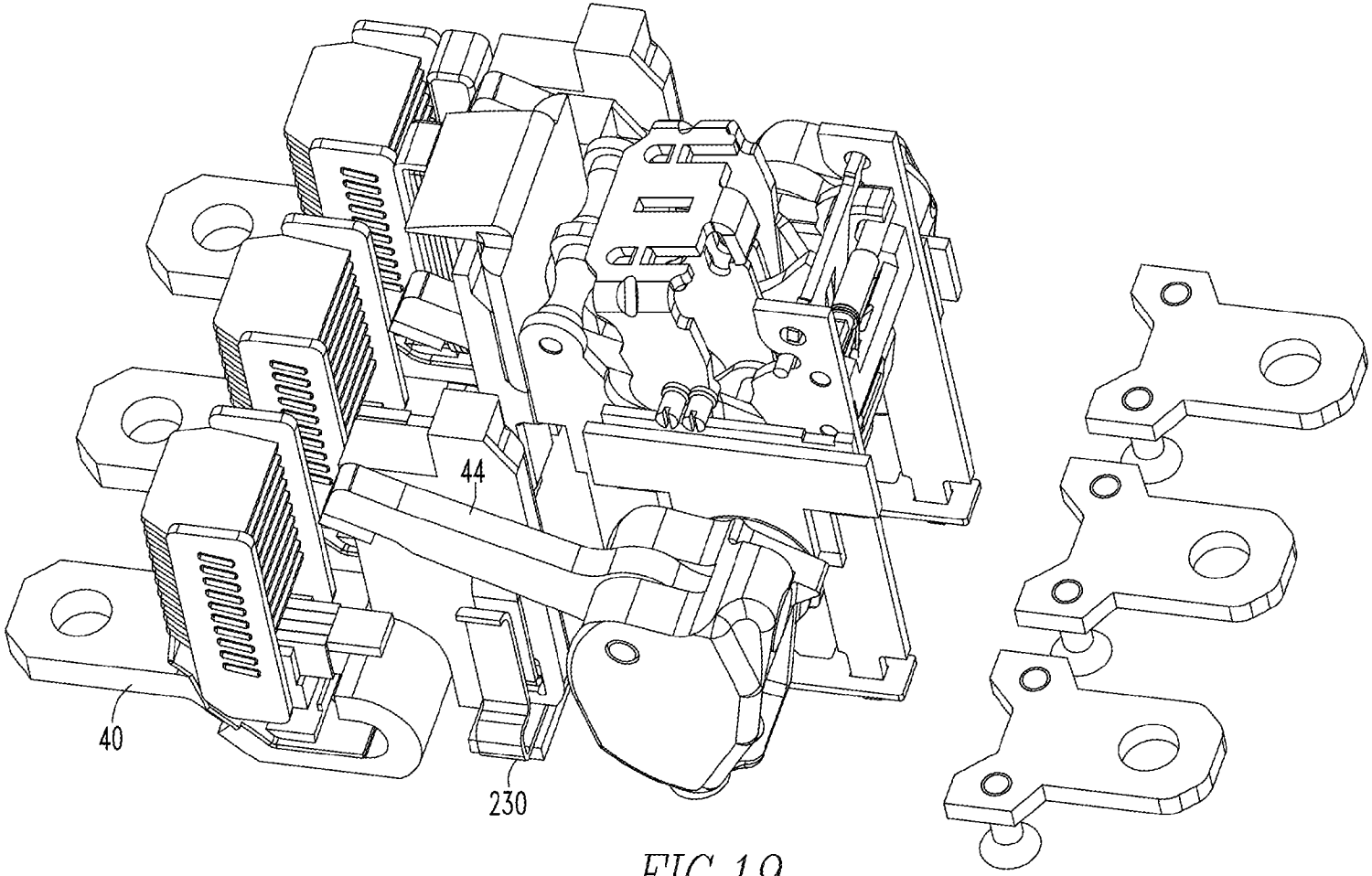
FIG. 19 is a partial isometric view of a hybrid circuit breaker assembly.
Figure 20:
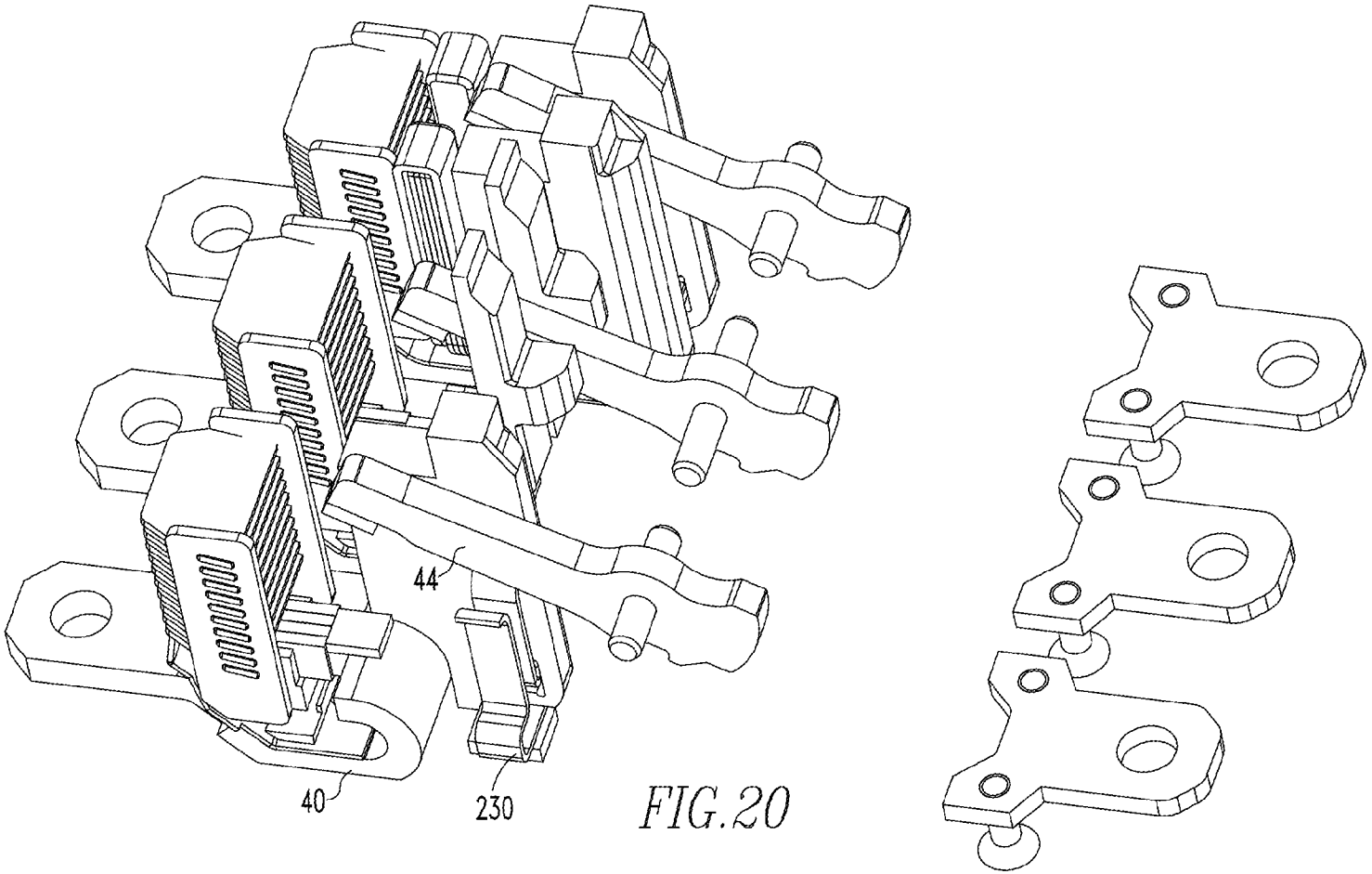
FIG. 20 is another partial isometric view of a hybrid circuit breaker assembly.

As shown in FIG. 2-20, a molded case circuit breaker assembly 10 (hereinafter "circuit breaker assembly") includes a housing assembly 12, an operating mechanism 14 and a number of conductor assemblies 16. Each conductor assembly 16 includes a pair of separable contacts 18. Typically, there is one conductor assembly 16 for each pole of the circuit breaker assembly 10. An exemplary three-pole circuit breaker assembly 10 is shown. The housing assembly 12 defines an enclosed space 13. The housing assembly 12 includes an elongated base portion 20 which is coupled to an elongated primary cover 22 (FIG. 2). As shown in FIG. 2, the base portion 20 includes a plurality of internal walls 24 defining a number of elongated cavities 26. In an exemplary embodiment, there is one cavity 26 for each pole of the circuit breaker assembly 10. As shown in FIG. 2, the primary cover 22 also includes a plurality of internal walls 30 which also define a number of elongated cavities 32. As noted above, in a three pole circuit breaker assembly 10 there are three base portion cavities 26 and three primary cover cavities 32. The base portion cavities 26 and primary cover cavities 32 extend generally parallel to each other and parallel to a longitudinal axis of the housing assembly 12. The base portion cavities 26 generally align with the primary cover cavities 32 so that when the primary cover 22 is coupled to the base portion 20, the base portion cavities 26 and the primary cover cavities 32 define a number of conductor chambers 34, and in an exemplary embodiment with a three-pole circuit breaker assembly 10, three conductor chambers 34.

Each conductor assembly 16 includes substantially similar elements and, as such, only one conductor assembly 16 will be described. It is understood that the elements described are associated with a single conductor assembly 16 and each conductor assembly 16 has a similar set of associated elements. Each conductor assembly 16 includes an elongated stationary conductor 40, a stationary contact 42, a movable conductor 44, a movable contact 46, and a movable conductor fixed portion 48. The separable contacts 18 include the stationary contact 42 and the movable contact 46. Each conductor assembly 16 is substantially disposed in the housing assembly enclosed space 13.

The stationary contact 42 is coupled to, and in an exemplary embodiment directly coupled to, as well as in electrical communication with, the stationary conductor 40. In another exemplary embodiment, the stationary contact 42 is unitary with, the stationary conductor 40. Each stationary contact 42 has a generally planar upper surface 43. The stationary conductor 40 is, in an exemplary embodiment, an elongated body 62 including a first end 64, a medial portion 66, and a second end 68. The stationary conductor body first end 64 is curled over the stationary conductor body medial portion 66 with a space or gap between the stationary conductor body first end 64 and the stationary conductor body medial portion 66. That is, the stationary conductor body medial portion 66 includes a planar portion 65 and an arcuate portion 67. The arcuate portion 67 extends over an arc of at least ninety degrees and, as shown, in one embodiment over an arc of about one-hundred and eighty degrees. As shown, in one embodiment the stationary conductor body first end 64 is a planar member that extends in a plane generally parallel to the stationary conductor body medial portion planar portion 65. Further, the stationary contact 42 is disposed on the upper surface of the stationary conductor body first end 64. In an exemplary embodiment, the movable contact 46 engages the stationary contact upper surface 43 when in the second position.

The movable contact 46 is coupled to, and in an exemplary embodiment directly coupled to, as well as in electrical communication with, the movable conductor 44. In an exemplary embodiment, the movable contact 46 is unitary with the movable conductor 44. The movable conductor 44 is movably coupled to, and is in electrical communication with, the movable conductor fixed portion 48. The movable contact 46, and more specifically, the movable conductor 44, is coupled to an operating mechanism 14. The operating mechanism 14 is structured to move the movable contact 46 between a first, open position wherein the contacts 18 are separated and are not in electrical communication, and, a second, closed position wherein the contacts 18 are coupled (or directly coupled) and are in electrical communication. Further, as the movable contact 46 moves between the first position and the second position, the movable contact 46 moves through a transition position. That is, when the movable contact 46 initially separates from the stationary contact 42 while carrying current, an electrical arc is drawn between the contacts 42, 46. The electrical arc continues to carry current till the current commutates from the electrical contact current path, i.e., the current path through the contacts 42, 46, to a current path through the power electronic circuit assembly 160, discussed below. Once there is no current flowing through the contact current path, the electrical arc is extinguished.

It is understood that when the contacts 18 are in the first position, the stationary conductor 40 and the associated movable conductor 44 are not in electrical communication. Further, when the contacts 18 are in the second position, the stationary conductor 40 and the associated movable conductor 44 are in electrical communication. Further, it is understood that the movable conductor 44 moves between a first position and a second position, as well as an arc position, corresponding to the movable contact 46. It is further understood that each stationary conductor 40 and each movable conductor 44 include a terminal that is structured to be coupled to, and placed in electrical communication with, a line or load (neither shown).

The operating mechanism 14 is coupled to a trip assembly 100 and a handle 102. The handle 102 is part of the operating mechanism 14. The operating mechanism 14 may be actuated manually by the handle 102, or, actuated, in response to an over-current condition, by the trip assembly 100. The operating mechanism 14 is substantially disposed in the housing assembly enclosed space 13.

In an exemplary embodiment, each conductor assembly 16 is disposed in an associated conductor chamber 34. Each conductor chamber 34 also includes an arc chute assembly 70 as are known. In an exemplary embodiment, the stationary conductor body first end 64 is disposed immediately adjacent the arc chute assembly 70. As used herein, "immediately adjacent" means with no other constructs therebetween. In another embodiment, not shown, there is an arc runner structure at the end of the stationary conductor body first end 64 to allow the electrical arc to move away from the stationary contact. In an exemplary embodiment, each conductor chamber 34 further includes a power electronic switch assembly cavity 120. As shown, each power electronic switch assembly cavity 120 is contiguous with an associated conductor chamber 34. Further, each power electronic switch assembly cavity 120 is disposed adjacent, or immediately adjacent, the associated contacts 18. That is, unlike the prior art, the stationary conductor body first end 64 is not disposed immediately adjacent the arc chute assembly 70. Rather, the stationary conductor body first end 64 is disposed immediately adjacent power electronic switch assembly cavity 120. As used herein, a stationary conductor body first end 64 that is disposed adjacent arc chute assembly 70 is part of a "full length" stationary conductor 40. Conversely, a "reduced length" stationary conductor 40, as used herein, is a stationary conductor 40 that is structured to be spaced from an associated arc chute assembly 70. Further, as used herein, a stationary conductor 40 that is structured so as to accommodate a power electronic switch assembly 150, discussed below, between the stationary conductor body first end 64 and an arc chute assembly 70 is a "shortened" stationary conductor 40. That is, a stationary conductor 40 that has a reduced length so as to accommodate constructs other than a power electronic switch assembly 150 are not a "shortened" stationary conductor 40. It is understood that only conductor assemblies 16 having a power electronic switch assembly 150 need to be shortened stationary conductors 40. Thus, a number of stationary conductors 40 are shortened stationary conductors.

The circuit breaker assembly 10 further includes a hybrid switch assembly 140. The hybrid switch assembly 140 includes the conductor assemblies 16, described above, as well as a power electronic switch assembly 150. Each power electronic switch assembly 150 includes substantially similar elements and, as such, only one power electronic switch assembly 150 will be described. It is understood that the elements described are associated with a single power electronic switch assembly 150 and each power electronic switch assembly 150 has a similar set of associated elements.

Each power electronic switch assembly 150 is structured to commutate and interrupt a current. Further, each power electronic switch assembly 150 is structured to be powered by an arc voltage and system voltage. Each power electronic switch assembly 150 is structured to be disposed within an associated power electronic switch assembly cavity 120. That is, the power electronic switch assembly 150, and elements thereof (discussed below) are disposed within the housing assembly enclosed space 13 and therefore are not disposed within a separate housing assembly enclosed space.

In an exemplary embodiment, each power electronic switch assembly 150 includes a power electronic circuit assembly 160 and a power electronic switch conductor assembly 200. Thus, each power electronic circuit assembly 160 is structured to commutate and interrupt a current as well as to be powered by an arc voltage and system voltage. In an exemplary embodiment, each power electronic circuit assembly 160 is structured to change between a first state, wherein a current cannot pass through the power electronic circuit assembly 160, and, a second state, wherein a current can pass through the power electronic circuit assembly 160. In an exemplary embodiment, the power electronic circuit assembly 160 switches between the first and second state in between about 50 μs to 200 μs, or less than about 100 μs, or less than 100 μs. Further, each power electronic circuit assembly 160 is structured to receive a trigger signal and to switch between the first state and the second state when the trigger signal is received.

In an exemplary embodiment, the power electronic circuit assembly 160 is an Insulated Gate Bipolar Transistor circuit assembly 162, hereinafter "IGBT circuit assembly" 162. In an exemplary embodiment, each IGBT circuit assembly 162 includes a first IGBT circuit 164 and a second IGBT circuit 165, a first terminal 166 and a second terminal 168. Each IGBT circuit 164, 165 includes a first IGBT 170 and second IGBT 172, disposed in series, as well as a voltage dependent resistor 174, disposed in parallel to the first and second IGBT 170, 172. Each IGBT circuit 164, 165 also includes a first terminal 176 and a second terminal 178. The IGBT circuit assembly first terminal 166 (also identified as the power electronic switch conductor assembly first terminal 166) is coupled to, and is in electrical communication with the associated stationary conductor 40. The IGBT circuit assembly second terminal 168 (also identified as the power electronic switch conductor assembly second terminal 168) is coupled to, and is in electrical communication with the associated movable conductor 44. Further, a power electronic circuit assembly 160 that does not include an IGBT circuit assembly 162 still includes assembly terminals (not shown) that are coupled to the stationary and movable conductors 40, 44.

The power electronic switch conductor assembly 200 includes a first bus 202, a mechanical trigger relay assembly 204, and a second bus 206. The power electronic switch conductor assembly mechanical trigger relay assembly 204, hereinafter "mechanical trigger relay assembly" 204, includes a relay 210 that is structured to be mechanically actuated, i.e., switched, as well as an electronic circuit 211. The mechanical trigger relay assembly 204 is further structured to provide a trigger signal via the electronic circuit 211. That is, when the mechanical trigger relay assembly relay 210 is actuated, the mechanical trigger relay assembly 204 provides a trigger signal via the electronic circuit 211. The mechanical trigger relay assembly 204 is in electronic communication with the power electronic circuit assembly 160 and provides the trigger signal thereto. As stated above, each power electronic circuit assembly 160 is structured to receive a trigger signal and to switch between the first state and the second state when the trigger signal is received.

In this configuration when each movable conductor 44 moves from the second position to the first position, and when the movable conductor 44 is in the transition position, the power electronic circuit assembly 160 is in electrical communication with the movable conductor 44 and the stationary conductor 40 and the current passes through the power electronic circuit assembly 160. Further, in this configuration, the power electronic circuit assembly 160 commutates and interrupts the current. That is, when the movable conductor 44 is in the transition position, the movable conductor 44 operatively engages the mechanical relay assembly relay 210. Thus, the mechanical relay assembly relay 210 is actuated and the mechanical trigger relay assembly 204 provides the trigger signal to the power electronic circuit assembly 160. As stated above, when the power electronic circuit assembly 160 receives the trigger signal, the power electronic circuit assembly switches states, which in this instance is first from the first state to the second state, and then from the second state to the first state after a predefined time such as 100 □s. Stated generally, when the movable contact 46 moves between the second position and the first position, i.e., when the contacts 18 open, an arc is generated, and the current continues to flow through the contact conducting path, i.e., the conductor assembly 16, until the mechanical trigger relay assembly 204 is actuated by the movable conductor 44. When the mechanical trigger relay assembly 204 is actuated by the movable conductor 44, the power electronic circuit assembly 160 switches states from the first state to the second state, commutates and interrupts the arc current. As there is neither arc voltage nor system voltage across the conductor assembly 16 after current commutation, the power electronic circuit 160 is powered by energy stored in the power electronic circuit 160 for the predefined time and turns off the IGBTs. That is, each IGBT circuit assembly 162 moves from the first state to the second state. The movable conductor 44 (and movable contact 46) then move(s) into the first position whereupon the first and second conductors 40, 44 are not in electrical communication.

Conversely, when each movable conductor 44 moves from the first position to the second position, and when the movable conductor 44 is in the transition position, the movable conductor 44 operatively engages the mechanical trigger relay assembly actuator 210. Thus, the mechanical trigger relay assembly relay 210 is actuated and the mechanical trigger relay assembly 204 provides the trigger signal to the power electronic circuit assembly 160. In this instance, the power electronic circuit assembly 160 was in the first state and is switched to the second state upon receiving the trigger signal. When the power electronic circuit assembly 160 is in the second state and when the movable conductor 44 is in the transition position, the power electronic circuit assembly 160 is in electrical communication with the movable conductor 44 and the stationary conductor 40 and the arc current passes through the power electronic circuit assembly 160. Further, when the movable conductor 44 is in the second position, current bypasses the power electronic circuit assembly 160 and flows through the contact current path, i.e., through the movable contact 46 and the stationary contact 42. As there is neither arc voltage nor system voltage across the power electronic circuit assembly 160, the power electronic circuit assembly 160 turns itself off, i.e., moves from the first state to the second state and stops conducting.

As discussed above, when the movable conductor 44 is in the second position, the associated power electronic switch assembly 150 is not in electrical communication with either the movable conductor 44 or the stationary conductor 40. That is, when the movable conductor 44 is in the second position, the path of least resistance for the current is through the contacts 18 and the current bypasses the power electronic switch assembly 150.

Further, in an exemplary embodiment, each power electronic switch conductor assembly 200 includes a clinch joint assembly 220. The power electronic switch conductor assembly clinch joint assembly 220, hereinafter "clinch joint assembly" 220, in conjunction with a movable contact 46, is structured to isolate the power electronic circuit assembly 160. Stated alternately, the power electronic switch assembly 150 includes an isolation contact assembly 222 wherein the power electronic switch assembly isolation contact assembly 222, hereinafter "isolation contact assembly" 222 includes the clinch joint assembly 220 and the movable contact 46. The isolation contact assembly 222 is selectively coupled to, and in electric communication with, both the stationary conductor 40 and the movable conductor 44 via the power electronic circuit assembly 160.

In an exemplary embodiment, each clinch joint assembly 220 includes a conductive clevis 230 and a conductive lug 232. As shown, and in an exemplary embodiment, the clinch joint assembly lug 232 is a portion, i.e., a medial portion 45 of the movable conductor 44. The clinch joint assembly clevis 230 is coupled, directly coupled, or fixed to the housing assembly 12. As shown, the clinch joint assembly clevis 230 includes two tines 236, 238 disposed on either side of the movable conductor 44. The clevis tines 236, 238 are spaced to snuggly correspond to the width of the movable conductor 44. Thus, the movable conductor 44, and therefore the clinch joint assembly lug 232, is movably coupled to a clinch joint assembly clevis 230 while the movable conductor 44 moves over a portion of its path.

That is, the clinch joint assembly lug 232 is in electrical communication with the clinch joint assembly clevis 230 over a portion of its path of travel. Thus, when the clinch joint assembly lug 232 is disposed within the clinch joint assembly clevis 230, the clinch joint assembly 220 is in a closed configuration wherein the clinch joint assembly lug 232 is in electrical communication with the clinch joint assembly clevis 230. Further, when the clinch joint assembly lug 232 moves beyond the clinch joint assembly clevis 230, the clinch joint assembly 220 is in an open configuration wherein the clinch joint assembly lug 232 is not in electrical communication with the clinch joint assembly clevis 230.

In this embodiment, and when each movable contact 46 moves between the first and second position, as described above, the clinch joint assemblies 220 operate as follows.

When the movable contact(s) 46 moves from the second position to the first position, i.e., when opening, the movable conductor 44 engages the mechanical trigger relay assembly 204 and the power electronic circuit assembly 160 switches from the second state to the first state before the clinch joint assemblies 220 move into the open configuration. Conversely, when the movable contact(s) 46 moves from the first position to the second position, i.e., when closing, the movable conductor 44, i.e., the clinch joint assembly lug 232, engages with the clinch joint assembly clevis 230 (moves to the second configuration) before the movable conductor 44 engages the mechanical trigger relay assembly 204 or the power electronic circuit 160 switches from the first state to the second state.

That is, in an exemplary embodiment, the clinch joint assembly clevis 230 moves over a path 240. The clinch joint assembly clevis 230 has a limited height relative to the clinch joint assembly lug path 240. Stated alternately, the clinch joint assembly lug path 240 moves above the clinch joint assembly clevis 230. Thus, the clinch joint assembly lug path 240 includes a first portion 242 and a second portion 244. The clinch joint assembly lug path first portion 242 is that portion of the clinch joint assembly lug path 240 wherein the clinch joint assembly lug 232 is in electrical communication with the clinch joint assembly clevis 230, i.e., when the clinch joint assembly lug 232 is between the clevis tines 236, 238. The clinch joint assembly lug path second portion 244 is that portion of the clinch joint assembly lug path 240 wherein the clinch joint assembly lug 232 is not in electrical communication with the clinch joint assembly clevis 230, i.e., when the clinch joint assembly lug 232 is not between the clevis tines 236, 238. Further, the clinch joint assembly lug path second portion 244 is disposed at a location wherein an arc cannot occur. Stated alternately, the transition position occurs when the clinch joint assembly lug 232 is in the clinch joint assembly lug path first portion 242. Further, the movable contact 46 is in the first position when the clinch joint assembly lug 232 is at the distal end of the clinch joint assembly lug path second portion 244, i.e., the end of the clinch joint assembly lug path second portion 244 furthest from the clinch joint assembly lug path first portion 242. Conversely, the movable contact 46 is in the second position when the clinch joint assembly lug 232 is at the distal end of the clinch joint assembly lug path first portion 242, i.e., the end of the clinch joint assembly lug path first portion 242 furthest from the clinch joint assembly lug path second portion 244.

As is known, generation of an arc produces arc gasses which may damage other components. Thus, in an exemplary embodiment, each power electronic switch assembly 150 includes a gassing assembly 260. The gassing assembly 260 is structured to be substantially disposed about the power electronic circuit assembly 160. Stated alternately, each power electronic circuit assembly 160 is disposed within an associated gassing assembly 260. In an exemplary embodiment, the gassing assembly 260 includes a barrier 262 disposed immediately adjacent the clinch joint assembly clevis 230. In one embodiment, the barrier 262 includes 30% glass fiber filled PA66 and has a generally U-shaped contour. That is, the barrier 262 generally corresponds to the shape of the clinch joint assembly clevis 230 but may have a greater height. Further, in an exemplary embodiment, the gassing assembly 260, as well as the barrier 262, are sized and shaped to be disposed within a power electronic switch assembly cavity 120.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A hybrid switch assembly for a circuit breaker assembly, said circuit breaker assembly including a housing assembly and an operating mechanism, said housing assembly defining a power electronic switch assembly cavity, said operating mechanism structured to move a number of movable conductors between an open, first position, wherein each movable conductor is spaced from and not in electrical communication with a stationary conductor, and a closed, second position, wherein each movable conductor is coupled to and in electrical communication with a stationary conductor, said hybrid switch assembly comprising:

a number of conductor assemblies, each conductor assembly including a movable conductor and a stationary conductor;

wherein each movable conductor is movably coupled to said housing assembly and structured to move between an open, first position, wherein each movable conductor is spaced from and not in electrical communication with an associated stationary conductor, and a closed, second position, wherein each movable conductor is coupled to and in electrical communication with an associated stationary conductor;

a power electronic switch assembly; and each power electronic switch assembly structured to commutate and interrupt a current.

2. The hybrid switch assembly of claim 1 wherein:

each said power electronic switch assembly includes power electronic circuit assembly and a power electronic switch conductor assembly;

each said power electronic circuit assembly structured to commutate and interrupt a current;

each said power electronic switch conductor assembly including a first bus and a second bus;

each said power electronic switch conductor first bus coupled to, and in electrical communication with, an associated stationary conductor and said power electronic circuit assembly; and each second bus coupled to, and in electrical communication with, an associated movable conductor and said power electronic circuit assembly.

3. The hybrid switch assembly of claim 2 wherein each said power electronic circuit assembly is structured to change between a first state, wherein a current cannot pass through said power electronic circuit assembly, and, a second state, wherein a current can pass through said power electronic circuit assembly.

4. The hybrid switch assembly of claim 3 wherein:

each said power electronic switch assembly includes a mechanical trigger relay assembly;

each said mechanical trigger relay assembly including a relay and an electronic circuit;

each said mechanical trigger relay assembly structured to provide a trigger signal via the electronic circuit;

each said mechanical trigger relay assembly relay disposed in the path of travel of an associated movable conductor;

wherein, when said mechanical trigger relay assembly relay is actuated, said mechanical trigger relay assembly provides said trigger signal;

each said power electronic circuit assembly structured to receive a trigger signal and to switch between said first state and said second state when said trigger signal is received; and each said mechanical trigger relay assembly in electronic communication with an associated power electronic circuit assembly.

5. The hybrid switch assembly of claim 4 wherein, when said movable conductor is in said second position, an associated power electronic switch assembly is not in electrical communication with either said movable conductor or said stationary conductor.

6. The hybrid switch assembly of claim 5 wherein each said power electronic switch assembly is structured to be powered by an arc voltage and system voltage.

7. The hybrid switch assembly of claim 6 wherein, when each said movable contact moves between said first position and said second position, said movable contact moves through a transition position, generates an arc, current then commutates to power electronic circuit and wherein:

when each said movable conductor moves from said second position to said first position, and when said movable conductor is in said transition position, said power electronic circuit assembly is in electrical communication with said movable conductor and said stationary conductor and said current passes through said power electronic circuit assembly; and wherein said power electronic circuit assembly interrupts said current.

8. The hybrid switch assembly of claim 7 wherein:

when said movable conductor is in said transition position, said movable conductor operatively engages said mechanical trigger relay assembly relay;

wherein said mechanical trigger relay assembly relay is actuated and said mechanical trigger relay assembly provides said trigger signal to said power electronic circuit assembly via said electronic circuit; and wherein said power electronic circuit assembly switches from said first state to said second state, and then switches from said second state to said first state after a predefined time.

9. The hybrid switch assembly of claim 6 wherein, when each said movable contact moves between said first position and said second position, said movable contact moves through a transition position and generates an arc current, and wherein:

when each said movable conductor moves from said first position to said second position, and when said movable conductor is in said transition position, said movable conductor operatively engages said mechanical trigger relay assembly relay;

wherein said mechanical trigger relay assembly relay is actuated and said mechanical trigger relay assembly provides said trigger signal to said power electronic circuit assembly;

wherein said power electronic circuit assembly switches from said first state to said second state;

wherein said power electronic circuit assembly is in electrical communication with said movable conductor and said stationary conductor and said arc current passes through said power electronic circuit assembly; and when said movable conductor is in said second position, current bypasses said power electronic circuit assembly.

10. The hybrid switch assembly of claim 2 wherein:

each said power electronic switch assembly includes an isolation contact assembly; and each said isolation contact assembly is structured to be selectively coupled, and in electric communication with, said stationary conductor and said movable conductor via said power electronic circuit assembly.

11. The hybrid switch assembly of claim 10 wherein:

each power electronic switch conductor assembly includes a clinch joint assembly;

each clinch joint assembly including a clevis and a lug;

wherein each said clinch joint assembly lug is a portion of an associated movable conductor; and wherein each said clinch joint assembly lug is movably coupled to a clinch joint assembly clevis.

12. The hybrid switch assembly of claim 11 wherein:

each said clinch joint assembly lug moves over a path;

each said clinch joint assembly lug path including a first portion and a second portion;

wherein, as each said clinch joint assembly lug moves over said clinch joint assembly lug path first portion, each said power switch clinch joint assembly lug is in electrical communication with an associated power switch clinch joint assembly clevis; and wherein, as each said power switch clinch joint assembly lug moves over said switch clinch joint assembly lug path second portion, each said power switch clinch joint assembly lug is not in electrical communication with an associated power switch clinch joint assembly clevis.

13. The hybrid switch assembly of claim 3 wherein the power electronic circuit assembly is an IGBT circuit assembly.

14. The hybrid switch assembly of claim 1 wherein:

each power electronic switch assembly includes a gassing assembly; and each said power electronic circuit assembly disposed within an associated gassing assembly.

15. The hybrid switch assembly of claim 1 wherein each power electronic switch assembly is structured to be disposed with in an associated power electronic switch assembly cavity.

16. The hybrid switch assembly of claim 1 wherein said, housing assembly defines a number of conductor chambers wherein each power electronic switch assembly cavity is contiguous with an associated conductor chamber, and wherein each power electronic switch assembly is structured to be disposed within an associated power electronic switch assembly cavity.

17. A circuit breaker assembly comprising:

a housing assembly defining an enclosed space;

an operating mechanism substantially disposed in said housing assembly enclosed space;

said housing assembly further defining a power electronic switch assembly cavity;

said operating mechanism structured to move a number of movable conductors between an open, first position, wherein each movable conductor is spaced from and not in electrical communication with a stationary conductor, and a closed, second position, wherein each movable conductor is coupled to and in electrical communication with a stationary conductor;

a hybrid switch assembly including a number of conductor assemblies, each conductor assembly substantially disposed in said housing assembly enclosed space;

each conductor assembly including a movable conductor and a stationary conductor;

wherein each movable conductor is movably coupled to said housing assembly and structured to move between an open, first position, wherein each movable conductor is spaced from and not in electrical communication with an associated stationary conductor, and a closed, second position, wherein each movable conductor is coupled to and in electrical communication with an associated stationary conductor;

a number of said conductor assemblies further including a power electronic switch assembly; and each power electronic switch assembly structured to commutate and interrupt a current.

18. The circuit breaker assembly of claim 17 wherein a number of stationary conductors are shortened stationary conductors.

* * * * *